US006250342B1

(12) United States Patent
Lonardelli

(10) Patent No.: US 6,250,342 B1
(45) Date of Patent: Jun. 26, 2001

(54) CV JOINT BOOT CLAMP TIGHTENING TOOL

(76) Inventor: David Lonardelli, 1544 E. Quincy Ave., #A-6, Orange, CA (US) 92867

( * ) Notice: Subject to any disclaimer, the term of this patent is extended or adjusted under 35 U.S.C. 154(b) by 0 days.

(21) Appl. No.: 09/388,956

(22) Filed: Sep. 2, 1999

(51) Int. Cl.[7] ..... B21F 9/00
(52) U.S. Cl. ..... 140/123.5; 81/9.3
(58) Field of Search ..... 81/9.3; 140/93.4, 140/123.5, 123.6, 153; 254/213, 223, 225

(56) References Cited

U.S. PATENT DOCUMENTS 1,442,403 * 1/1923 Gunn ..... 81/9.3
1,915,682 * 6/1933 Maeda ..... 140/123.5
4,646,591 * 3/1987 Jansen ..... 81/9.3
5,848,620 * 12/1998 Yu ..... 140/123.5

* cited by examiner

*Primary Examiner*—Lowell A. Larson

(57) ABSTRACT

A clamp tightening tool is provided including an inboard extent, an intermediate extent integrally coupled to the inboard extent. The intermediate extent includes a cut out formed between a top face and a bottom face of the intermediate extent. A bore is formed between side faces of the intermediate extent. Also included is an outboard extent integrally coupled to the intermediate extent and has a slot formed through the outboard extent in perpendicular with the bore. Rotatably mounted within the bore of the intermediate extent is a crank with a slit for engaging an end of a clamp and reeling the same through the slot for tightening purposes.

1 Claim, 2 Drawing Sheets

CV JOINT BOOT CLAMP TIGHTENING TOOL

BACKGROUND OF THE INVENTION

1. Field of the Invention

The present invention relates to wrenches and more particularly pertains to a new cv(constant velocity) joint boot clamp tightening tool for tightening a clamp used to maintain a cv joint boot on an axle of a vehicle.

2. Description of the Prior Art

The use of wrenches is known in the prior art. More specifically, wrenches heretofore devised and utilized arc known to consist basically of familiar, expected and obvious structural configurations, notwithstanding the myriad of designs encompassed by the crowded prior art which have been developed for the fulfillment of countless objectives and requirements.

Known prior art wrenches and other types of tools include U.S. Pat. No. 2,371,439; U.S. Pat. No. 2,115,736; U.S. Pat. No. 3,981,049; U.S. Pat. No. 4,335,477; U.S. Pat. No. 4,724,729; and U.S. Pat. No. 4,459,717 which are each incorporated herein by reference.

In these respects, the cv joint boot clamp tightening, toot according to the present invention substantially departs from the conventional concepts and designs of the prior art, and in so doing, provides an apparatus primarily developed for the purpose of tightening a clamp used to maintain a cv joint boot on an axle of a vehicle.

SUMMARY OF THE INVENTION

In view of the foregoing, disadvantages inherent in the known types of wrenches now present in the prior art, the present invention provides a new cv joint boot clamp tightening tool construct ion wherein the same can be utilized for tightening a clamp used to maintain a cv joint boot on an axle of a vehicle.

The general purpose of the present invention, which will be described subsequently in greater detail, is to provide a new cv joint boot clamp tightening tool apparatus and method which has many of the advantages of the wrenches mentioned heretofore and many novel features that result i n a new cv joint boot clamp tightening tool which is not anticipated, rendered obvious, suggested, or even implied by any of the prior art wrenches, either alone or in any combination thereof.

To attain this, the present invention generally comprises a solid inboard extent with a cylindrical configuration. For gripping purposes, the inboard extent has a knurled outer Surface. The present invention further includes an intermediate extent integrally coupled to the inboard extent in coaxial relationship therewith. As shown in FIG. 3, the intermediate extent includes a pair of side faces spaced a distance about equal a diameter of the inboard extent. A top face and a bottom face of the intermediate extent have a planar inboard portion diverging from the inboard extent to an intermediate point. The top face and bottom face of the intermediate extent each further have a planar outboard portion converging from the intermediate point. As shown in FIG. 3, a cut out is formed between the top face and the bottom face of the intermediate extent. Such cut out is defined by a thin rectangular central part and a pair of wide square end parts. A bore is formed between the side faces of the intermediate extent through a center of the central part of the cut out. Such bore is also in-line with an interconnection between the inboard portion and the outboard portion of the top and bottom faces of the intermediate extent. Integrally coupled to the intermediate extent in coaxial relationship therewith is an outboard extent. The outboard extent includes a pair of side faces which converge from the intermediate extent to a free end. A top face and a bottom face of the outboard extent each also converge from the intermediate extent to the free end. A rectangular slot is formed through the outboard extent. This slot is equipped with a first opening in communication with the cut out of the intermediate extent and a second opening at the free end. Finally, a crank with an S-shaped configuration is provided having a pair of parallel members. One of such parallel members has a diametrically disposed slit formed therein along a length thereof. Further, such parallel member is equipped with an annular recess formed in its outer surface. As shown in FIG. 2, the parallel member with the slit and the recess is rotatably mounted within the bore of the intermediate extent. For maintaining the crank in position, a retainer clip is coupled to the annular recess. In use, the slit is adapted for engaging an end of a clamp such that the same may be reeled through the slot via the crank for tightening purposes.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new cv joint boot clamp tightening tool apparatus and method which has many of the advantages of the wrenches mentioned heretofore and many novel features that result in a new cv joint boot clamp tightening tool which is not anticipated, rendered obvious, suggested, or even implied by any of the prior art wrenches, either alone or in any combination thereof.

It is another object of the present invention to provide a new cv joint boot clamp tightening tool which may be easily and efficiently manufactured and marketed.

It is a further object of the present invention to provide a new cv joint boot clamp tightening tool which is of a durable and reliable construction.

An even further object of the present invention is to provide a new cv joint boot clamp tightening tool which is susceptible of a low cost of manufacture with regard to both materials and labor, and which accordingly is then susceptible of low prices of sale to the consuming public, thereby making such cv joint boot clamp tightening tool economically available to the buying public.

Still yet another object of the present invention is to provide a new cv joint boot clamp tightening tool which provides in the apparatuses and methods of the prior art some of the advantages thereof, while simultaneously overcoming some of the disadvantages normally associated therewith.

Still another object of the present invention is to provide a new cv joint boot clamp tightening tool for tightening a clamp used to maintain a cv joint boot on an axle of a vehicle.

Even still another object of the present invention is to provide a new cv joint boot clamp tightening tool that includes an inboard extent, an intermediate extent integrally coupled to the inboard extent. The intermediate extent includes a cut out formed between a top face and a bottom face of the intermediate extent. A bore is formed between side faces of the intermediate extent. Also included is an outboard extent integrally coupled to the intermediate extent and has a slot formed through the outboard extent in perpendicular with the bore. Rotatably mounted within the bore of the intermediate extent is a crank with a slit for engaging an end of a clamp and reeling the same through the slot for tightening purposes.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
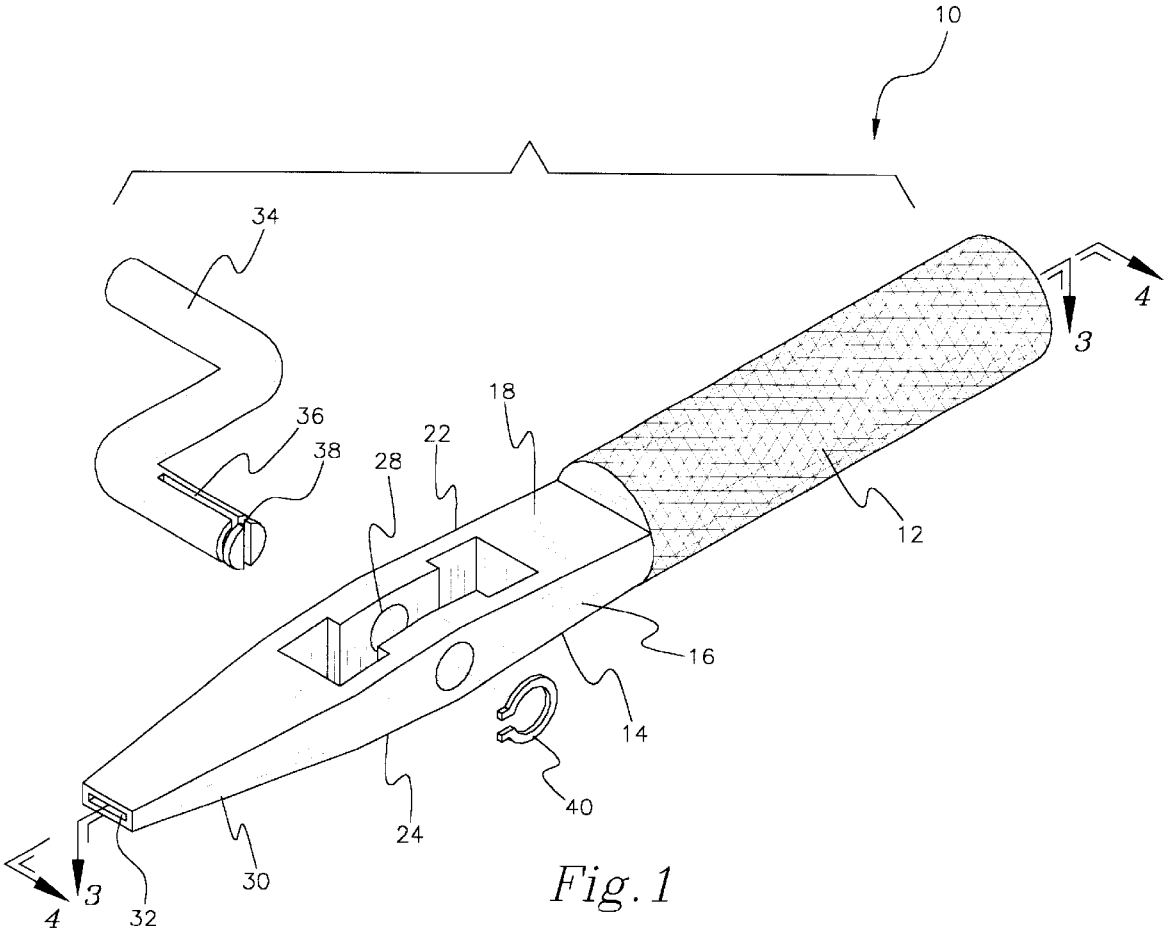
FIG. 1 is an exploded perspective view of a new cv joint boot clamp tightening tool according to the present invention.

With reference now to the drawings, and in particular to FIGS. 1 through 4 thereof, a new cv joint boot clamp tightening tool embodying the principles and concepts of the present invention and generally designated by the reference numeral 10 will be described.

The present invention, designated as numeral 10, includes a solid inboard extent 12 with a cylindrical configuration. For gripping purposes, the inboard extent has a knurled outer surface.

Figure 3:
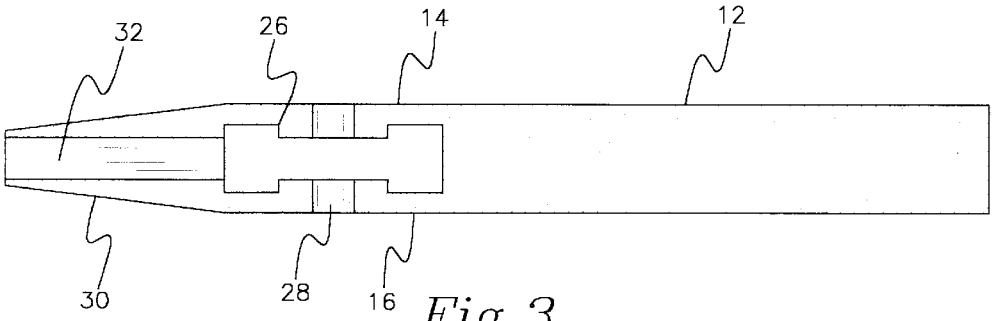
FIG. 3 is a top cross-sectional view of the present invention taken along line 3—3 shown in FIG. 1.
Figure 4:
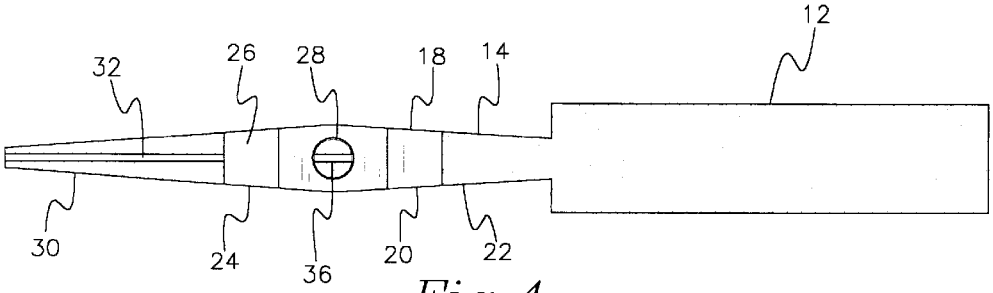
FIG. 4 is a side cross-sectional view of the present invention taken along line 4—4 shown in FIG. 1.

The present invention further includes an intermediate extent 14 integrally coupled to the inboard extent in coaxial relationship therewith. As shown in FIG. 3, the intermediate extent includes a pair of side faces 16 spaced a distance about equal a diameter of the inboard extent. A top face 18 and a bottom face 20 of the intermediate extent have a planar inboard portion 22 diverging from the inboard extent to an intermediate point. The top face and bottom face of the intermediate extent further have a planar outboard portion 24 converging from the intermediate point.

As shown in FIG. 3, a cut out 26 is formed between the top face and the bottom face of the intermediate extent. Such cut out is defined by a thin rectangular central part and a pair of wide square end parts. A bore 28 is formed between the side faces of the intermediate extent through a center of the central part of the cut out. Such bore is also in-line with an interconnection between the inboard portion and the outboard portion of the top and bottom faces of the intermediate extent.

Integrally coupled to the intermediate extent in coaxial relationship therewith is an outboard extent 30. The outboard extent includes a pair of side faces which converge from the intermediate extent to a free end. A top face and a bottom face of the outboard extent each also converge from the intermediate extent to the free end. A rectangular slot 32 is formed through the outboard extent. This slot is equipped with a first opening in communication with the cut out of the intermediate extent and a second opening at the free end. The rectangular slot preferably has a cross-section with a length which is at least four times its width.

Figure 2:
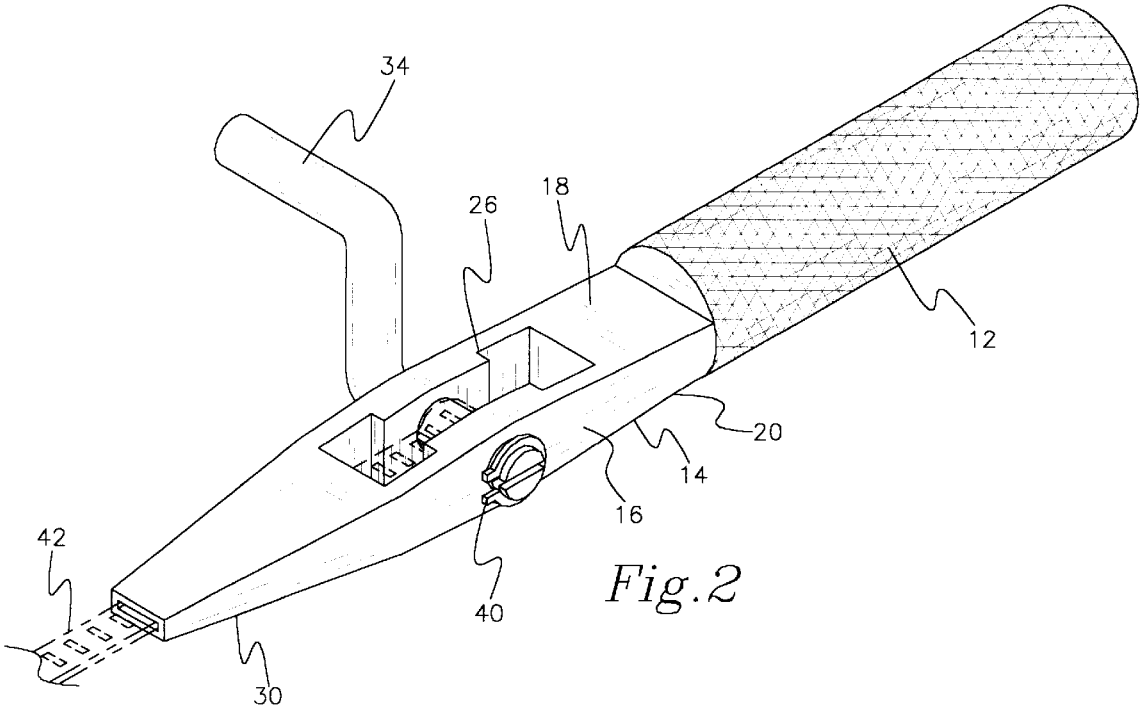
FIG. 2 is a perspective view of the present invention assembled and in use.

Finally, a crank 34 with an S-shaped configuration is provided having a pair of parallel members. One of such parallel members has a diametrically disposed slit 36 formed therein along a length thereof. As shown in FIG. 2, the slit extends to an end of the associated parallel member. Further, such parallel member is equipped with an annular recess 38 formed in its outer surface. As shown in FIG. 2, the parallel member with the slit and the recess is rotatably mounted within the bore of the intermediate extent. For maintaining the crank in position, a C-shaped retainer clip 40 is coupled to the annular recess.

In use, the slit is adapted for receiving an end of a clamp such that the same may be reeled through the slot via the crank for tightening purposes. Such clamp 42 is commercially available and used to maintain a cv(constant velocity) joint boot on an axle. The present invention affords more room and is easier to use that conventional wrenches.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A constant velocity joint boot clamp tightening tool comprising, in combination:

a solid inboard extent with a cylindrical configuration having a knurled outer surface;

an intermediate extent integrally coupled to the inboard extent in coaxial relationship therewith, the intermediate extent including a pair of side faces spaced a distance about equal a diameter of the inboard extent, a top face and a bottom face each having a planar inboard portion diverging from the inboard extent to an intermediate point and a planar outboard portion converging from the intermediate point, a cut out formed between the top face and the bottom face of the intermediate extent which is defined by a thin rectangular central part and a pair of wide square end parts, and a bore formed between the side faces of the intermediate extent through a center of the central part of the cut out and in-line with an interconnection between the inboard portion and the outboard portion of the top and bottom faces of the intermediate extent;

an outboard extent integrally coupled to the intermediate extent in coaxial relationship therewith, the outboard extent having a frustro-pyramidal shape including a pair of side faces each covering from the intermediate extent to a free end, a top face and a bottom face each converging from the intermediate extent to the free end, and a rectangular slot formed through the outboard extent with a first opening in communications with the cut out of the intermediate extent and a second opening at the free end, wherein the top and bottom faces extend between the side faces such that the top and bottom faces are adapted for supporting the clamp when the clamp is inserted through the slot in the outboard extent; and a crank with an S-shaped configuration having a pair of parallel members, a first one of the parallel members having a diametrically disposed slit formed therin along a length thereof and an annular recess formed in an outer surface thereof, wherein the first one of the parallel members is rotatably mounted in the bore of the intermediate extent to form a reel, a retainer clip being coupled to the annular recess at a location protruding from the bore for maintaining the crank in position, wherein the slit is adapted for receiving a portion of the clamp and reeling the same through the slot for tightening purposes, a second one of the parallel members forming a handle, the second parallel member being offset from the first parallel member by an offset member of the crank, the offset member transferring hand rotation of the handle by a user to rotation of the reel of the first parallel member.

* * * * *